US006224042B1

(12) United States Patent
Popov

(10) Patent No.: US 6,224,042 B1
(45) Date of Patent: May 1, 2001

(54) LIQUID-GAS EJECTOR

(76) Inventor: Serguei A. Popov, 4615 Post Oak Pl, Suite 140, Houston, TX (US) 77027

( * ) Notice: Subject to any disclaimer, the term of this patent is extended or adjusted under 35 U.S.C. 154(b) by 0 days.

(21) Appl. No.: 09/367,175

(22) PCT Filed: Dec. 11, 1998

(86) PCT No.: PCT/IB98/01999

§ 371 Date: Aug. 9, 1999

§ 102(e) Date: Aug. 9, 1999

(87) PCT Pub. No.: WO99/31392

PCT Pub. Date: Jun. 24, 1999

(30) Foreign Application Priority Data

Dec. 15, 1997 (RU) ..... 97120824

(51) Int. Cl.[7] ..... B01F 3/04
(52) U.S. Cl. ..... 261/76
(58) Field of Search ..... 261/76

(56) References Cited

U.S. PATENT DOCUMENTS 992,081 * 5/1911 Tait ..... 261/76
1,117,626 * 11/1914 Bassler ..... 261/76
2,382,391 8/1945 Berman .
3,707,067 * 12/1972 Dietrick ..... 261/76
5,628,623 5/1997 Skaggs .

FOREIGN PATENT DOCUMENTS 985462 12/1982 (SU) .
1483106 5/1989 (SU) .
1755714 8/1992 (SU) .

OTHER PUBLICATIONS

Sokolov E.Y., "Jet apparatuses" book, 1970, USSR, Moscow, "Energy" Publishing house, pp. 200–201, 211.

* cited by examiner

*Primary Examiner*—C. Scott Bushey
(74) *Attorney, Agent, or Firm*—Mark A. Oathout

(57) ABSTRACT

The present invention pertains to the field of jet technology and essentially relates to a liquid-gas ejector, including at least one nozzle and a mixing chamber corresponding to the nozzle, wherein the mixing chamber has a length of between 200 cm and 1400 cm while the operational pressure of a motive liquid at the nozzle's inlet is within the range from 6 atm (abs) to 240 atm (abs).

3 Claims, 1 Drawing Sheet

LIQUID-GAS EJECTOR

BACKGROUND OF THE INVENTION

The present invention pertains to the field of jet technology, primarily to liquidgas ejectors, which can be used in the petrochemical industry for producing a vacuum, for example in vacuum rectifying columns.

A liquid-gas ejector is known, which comprises an active nozzle, a mixing chamber, a diffuser and a receiving chamber. The length of the ejector's mixing chamber represents 7 times the diameter of the outlet cross-section of the ejector's nozzle (see, for example, book of Sokolov E. Y. and Zinger N. M., Jet apparatuses, M., Energy 1970, page 211).

Jet apparatuses of this type possess quite high capacity. At the same time they have a relatively low efficiency factor. This is why their range of application is limited.

The starting point for the present invention is a liquid-gas jet ejector comprising a nozzle and a mixing chamber, wherein the ratio of the length of a throat of the mixing chamber to the diameter of the throat is 11.5 (see book of Sokolov E. Y. and Zinger N. M., Jet apparatuses, M., Energy 1970, page 200–201).

Such apparatuses are widely used in power engineering as air-ejecting devices of condensing units and in vacuum water deaeration plants. The apparatuses allow evacuation of an air-vapor mixture from a condenser. They are able to boost the pressure of the evacuated medium from 0.02 . . . 0.06 atm(abs) up to the atmospheric pressure. However, these ejectors also have a relatively low efficiency factor due to nonoptimal geometry of the ejector's flow-through channel, which results in big hydraulic energy losses.

SUMMARY OF THE INVENTION

The objective of the present invention is to increase the efficiency factor of a liquid-gas ejector due to optimization of the flow regime in a mixing chamber of the ejector.

The stated objective is achieved as follows: a liquid-gas ejector having a nozzle and a mixing chamber has a mixing chamber whose length ranges from 200 cm to 1400 cm.

Experiments on the operation of liquid-gas ejectors were conducted on a bench in a wide range of the ejectors' capacities. The investigated ejectors had mixing chambers of different diameters and their characteristic dimension (the ratio of the surface area of the minimal cross-section of the mixing chamber to the surface area of the minimal cross-section of the nozzle) ranged from 5 to 250 (the mentioned book of Sokolov E. Y. & Zinger N. M., page 205, teaches that the like characteristic dimension be from 5 to 30). During the research it was discovered that the absolute length of the mixing chamber is one of the most important geometric parameters of a liquid-gas ejector. It also became clear that pressure of a liquid medium at the nozzle's inlet is the determinant parameter affecting the length of the mixing chamber. Therefore the experiments were conducted within a wide range of the motive liquid pressure. The pressure varied from 6 to 240 atm (abs), the mass coefficient of injection ranged from $10^{-3}$% to 14%. It was discovered, that within the above indicated range of the motive liquid pressure mixing of the liquid and evacuated gaseous mediums can not be completed in the mixing chamber if the length of the mixing chamber is smaller than 200 cm. A heterogeneous gas-liquid flow discharged from such mixing chambers is evidence of the imperfect mixing of the mediums. At the same time, expansion of the mixing chamber's length beyond 1400 cm does not improve the ejector's performance and causes only an increase in specific consumption of materials. The distance between the outlet cross-section of the nozzle and the outlet cross-section of the mixing chamber was interpreted as the length of the mixing chamber during the tests. It was also discovered, that the availability or absence of a diffuser at the outlet of the mixing chamber does not have an influence on the mixing chambers optimal length. The mixing chamber whose length is within the discovered optimal range provides complete mixing of liquid and evacuated gaseous mediums and a uniform gas-liquid flow in its outlet section. Under such conditions a pressure jump is generated in the zone of the outlet section of the mixing chamber and a liquid flow containing small gas bubbles is formed at the mixing chamber's outlet Thus the stated objective has been achieved: a complete mixing of liquid and gaseous mediums takes place in the mixing chamber, i.e. in the part of ejector's flow-through channel, which is specially assigned for this function. Such provides a reduction in energy losses and an increase in efficiency of a liquid-gas ejector.

DETAILED DESCRIPTION

Figure 1:
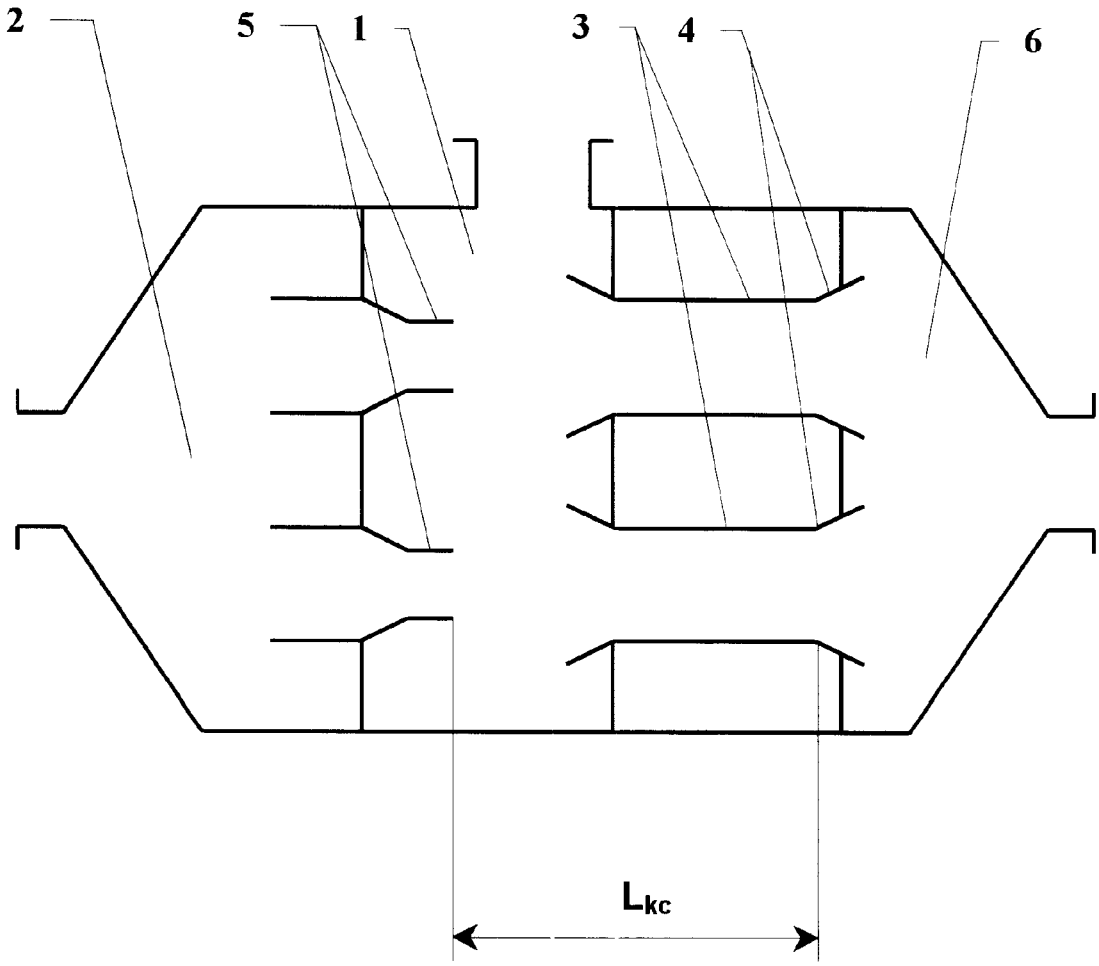
FIG. 1 is a schematic view of a liquid-gas ejector.

A liquid-gas ejector shown schematically in FIG. 1 has a receiving chamber 1, a distribution chamber 2, mixing chambers 3, diffusers 4, nozzles 5 and a discharge chamber 6. Length $L_{kc}$ of the mixing chambers 3, or, in other words, the distance between the outlet cross-sections of the nozzles 5 and the outlet cross-sections of the mixing chambers 3, ranges from 200 cm to 1400 cm. It is necessary to note, that such multi-nozzle ejector is one of the possible examples of an embodiment of the invention. However, the obtained experimental data teaches such distance holds true for both multi-nozzle and single-nozzle liquidgas ejectors. This means that if the operational pressure of a motive liquid of a liquid-gas ejector is from 6 to 240 atm (abs), the length of the ejector's mixing chamber must be between 200 cm and 1400 cm.

A liquid medium under pressure is fed into the distribution chamber 2. Pressure of the liquid medium at the nozzles' inlets is maintained within 6 . . . 240 atm (abs) range. The liquid medium flows from the distribution chamber 2 into the nozzles 5, where potential energy of pressure is partially transformed into kinetic energy of liquid jets. The liquid jets flowing from the nozzles 5 entrain an evacuated gaseous medium from the receiving chamber 1 to the mixing chambers 3. In the mixing chambers 3 the liquid medium is mixed up with the gaseous medium. In some cases condensation of a part of the gaseous medium, more precisely—of a vapor component of the evacuated gaseous medium, takes place in the mixing chambers 3. A liquid-gas mixture formed in the mixing chambers 3 flows into the diffusers 4 or, if there are no diffusers in an ejector, then directly into the discharge chamber 6. Then the mixture is discharged for utilisation.

Industrial Applicability

The described liquid-gas ejector can be used in chemical, petrochemical and some other industries.

What is claimed is:

1. A liquid-gas ejector, comprising:

at least one nozzle wherein a motive liquid at an inlet of the nozzle has an operational pressure within a range from 6 atmospheres (absolute) to 240 atmospheres (absolute); and a mixing chamber corresponding to the nozzle, wherein the mixing chamber has a length of between 200 cm and 1400 cm.

2. A liquid-gas ejector having a nozzle wherein a motive liquid at an inlet of the nozzle has an operational pressure within a range from 6 atmospheres (absolute) to 240 atmospheres (absolute), comprising:

the nozzle corresponding to a mixing chamber, wherein the mixing chamber has a length of between 200 cm and 1400 cm.

3. A liquid-gas ejector, comprising:

at least one nozzle having an inlet and a means for pressurizing a motive liquid at the inlet within a range from 6 atmospheres (absolute) to 240 atmospheres (absolute); and a mixing chamber corresponding to the nozzle, wherein the mixing chamber has a length of between 200 cm and 1400 cm.

* * * * *